US011538434B2

(12) United States Patent
Ran et al.

(10) Patent No.: US 11,538,434 B2
(45) Date of Patent: Dec. 27, 2022

(54) TIMING CONTROLLER FOR ADJUSTING REFRESH RATES BASED ON IMAGE SIGNALS AND METHOD FOR DRIVING DISPLAY DEVICE

(71) Applicants: CHONGQING BOE OPTOELECTRONICS TECHNOLOGY CO., LTD., Chongqing (CN); BOE TECHNOLOGY GROUP CO., LTD., Beijing (CN)

(72) Inventors: Bo Ran, Beijing (CN); Xianyong Gao, Beijing (CN); Ying Zhang, Beijing (CN); Yunsong Li, Beijing (CN); Shanbin Chen, Beijing (CN); Zhicai Xu, Beijing (CN); Sijun Lei, Beijing (CN); Liang Gao, Beijing (CN)

(73) Assignees: Chongqing BOE Optoelectronics Technology Co., Ltd., Chongqing (CN); Beijing BOE Technology Development Co., Ltd., Beijing (CN)

( * ) Notice: Subject to any disclaimer, the term of this patent is extended or adjusted under 35 U.S.C. 154(b) by 0 days.

(21) Appl. No.: 17/414,236

(22) PCT Filed: Sep. 24, 2020

(86) PCT No.: PCT/CN2020/117352
§ 371 (c)(1),
(2) Date: Jun. 15, 2021

(87) PCT Pub. No.: WO2021/057837
PCT Pub. Date: Apr. 1, 2021

(65) Prior Publication Data

US 2022/0028350 A1 Jan. 27, 2022

(30) Foreign Application Priority Data

Sep. 27, 2019 (CN) ..... 201910923227.6

(51) Int. Cl.
*G09G 3/36* (2006.01)

(52) U.S. Cl.
CPC ..... *G09G 3/3696* (2013.01); *G09G 3/3618* (2013.01); *G09G 2310/027* (2013.01); *G09G 2310/08* (2013.01)

(58) Field of Classification Search
CPC ..... G09G 3/3696
(Continued)

(56) References Cited

U.S. PATENT DOCUMENTS

2006/0038837 A1* 2/2006 Hong ..... G09G 3/3648 345/691
2007/0262940 A1 11/2007 Morimoto et al.
(Continued)

FOREIGN PATENT DOCUMENTS

CN 101071213 A 11/2007
CN 102467862 A 5/2012
(Continued)

OTHER PUBLICATIONS

First Office Action dated Feb. 2, 2021 by the China National Intellectual Property Administration for China patent application No. 201910923227.6.

*Primary Examiner* — Long D Pham
(74) *Attorney, Agent, or Firm* — IP & T Group LLP

(57) ABSTRACT

A timing controller includes a receiver and a processor. The receiver is configured to receive image signals of image frames to be displayed. The processor is configured to determine refresh rates of the image frames to be displayed according to the image signals of the image frames to be displayed, and output different control signals according to different refresh rates of the image frames to be displayed.

15 Claims, 8 Drawing Sheets

(58) Field of Classification Search
USPC ..... 345/55
See application file for complete search history.

(56) References Cited

U.S. PATENT DOCUMENTS

| | | | | |
|---|---|---|---|---|
| 2010/0149414 | A1 | 6/2010 | Chen et al. | |
| 2012/0120124 | A1 | 5/2012 | Zhang | |
| 2015/0103104 | A1 | 4/2015 | Lee et al. | |
| 2017/0309219 | A1* | 10/2017 | Kong | G09G 3/2003 |
| 2018/0053487 | A1 | 2/2018 | Cheng | |
| 2019/0005862 | A1 | 1/2019 | Zhang | |
| 2019/0043413 | A1* | 2/2019 | Kim | G09G 3/3266 |
| 2019/0096343 | A1 | 3/2019 | Hou et al. | |

FOREIGN PATENT DOCUMENTS

| | | | |
|---|---|---|---|
| CN | 106205460 | A | 12/2016 |
| CN | 107464540 | A | 12/2017 |
| CN | 109192168 | A | 1/2019 |
| CN | 109616083 | A | 4/2019 |
| CN | 110491351 | A | 11/2019 |
| JP | 2010148084 | A | 7/2010 |

* cited by examiner

TIMING CONTROLLER FOR ADJUSTING REFRESH RATES BASED ON IMAGE SIGNALS AND METHOD FOR DRIVING DISPLAY DEVICE

CROSS-REFERENCE TO RELATED APPLICATIONS

This application is a national phase entry under 35 USC 371 of International Patent Application No. PCT/CN2020/117352 filed on Sep. 24, 2020, which claims priority to Chinese Patent Application No. 201910923227.6, filed Sep. 27, 2019, which are incorporated herein by reference in their entirety.

TECHNICAL FIELD

The present disclosure relates to the field of display technologies, and in particular, to a timing controller, a driving system, a display device, and a method for driving a display device.

BACKGROUND

Liquid crystal displays (LCDs) have advantages of low radiation, small volume, low power consumption and the like, and are widely used in electronic products such as notebook computers, flat-panel televisions or mobile phones.

Currently, various types of liquid crystal displays, such as a twisted nematic (TN) type, an advanced super dimension switch (ADS) type, a high aperture ratio and advanced super dimension switch (HADS) type, and an in-plane switch (IPS) type, have been developed. Their driving modes or display effects are not exactly the same, and each has its own advantages.

Among the various types, the ADS type liquid crystal display has both its common electrode and pixel electrodes disposed on its array substrate, and are widely used due to its advantages of wide viewing angle, high aperture ratio, high transmittance and the like. In ADS technology, a multi-dimensional electric field is mainly composed of an electric field generated by edges of slit electrodes in a same plane and a electric field generated by a slit electrode layer and a plate electrode layer, so that in a liquid crystal cell all, liquid crystal molecules oriented in different directions between and above the slit electrodes can both rotate, thereby improving working efficiency of the liquid crystal and increasing light transmission efficiency. The ADS technology may improve an image quality of thin film transistor liquid crystal display (TFT-LCD) products, and has advantages of high resolution, high transmittance, low power consumption, wide viewing angle, high aperture ratio, low chromatic aberration, no push mura and the like. HADS is an important implementation form developed from the ADS technology, and has a greater aperture ratio.

In order to reduce power consumption, HADS type panels currently in use usually have two refresh rates. However, images displayed at the two refresh rates have different brightnesses. As a result, switching between the two refresh rates may cause a viewer to see an image flicker.

SUMMARY

In one aspect, a timing controller is provided. The timing controller includes a receiver and a processor. The receiver is configured to receive image signals of image frames to be displayed; and the processor is configured to determine refresh rates of the image frames to be displayed according to the image signals of the image frames to be displayed, and output different control signals according to different refresh rates of the image frames to be displayed.

In some embodiments, in a process of determining the refresh rates of the image frames to be displayed according to the image signals of the image frames to be displayed, the processor is configured to: resolve the image signals of the image frames to be displayed to obtain data signals and timing control signals; and determine the refresh rates of the image frames to be displayed according to the timing control signals.

In some embodiments, in a process of determining the refresh rates of the image frames to be displayed according to the timing control signals, the processor is configured to: determine the refresh rates of the image frames to be displayed according to time lengths each between any two adjacent active levels in a respective one of the timing control signals.

In some embodiments, in a process of determining the refresh rates of the image frames to be displayed according to the time lengths each between any two adjacent active levels in the respective one of the timing control signals, the processor is configured to: determine a refresh rate of a first image frame to be displayed to be a first refresh rate, according to a first time length between any two adjacent active levels in a first timing control signal; and determine a refresh rate of a second image frame to be displayed to be a second refresh rate, according to a second time length between any two adjacent active levels in a second timing control signal.

In some embodiments, in a process of outputting the different control signals according to the different refresh rates of the image frame to be displayed, the processor is configured to: output a first control signal according to the first refresh rate, the first refresh rate being the refresh rate of the first image frame to be displayed; and output a second control signal according to the second refresh rate, the second refresh rate being the refresh rate of the second image frame to be displayed.

In some embodiments, the timing controller further includes a memory. The memory is configured to store the image signals of the image frames to be displayed.

In another aspect, a driving system is provided. The driving system includes the timing controller according to any one of the above embodiments and a reference gray scale voltage generator. The reference gray scale voltage generator is connected to the timing controller, and is configured to output a group of reference gray scale voltages corresponding to each control signal, in response to a respective one of the different control signals received from the timing controller, each group of reference gray scale voltages including a plurality of reference gray scale voltages.

In some embodiments, the reference gray scale voltage generator includes a register and a controller. The register is configured to store at least two groups of reference gray scale voltage generation parameters, each group of reference gray scale voltage generation parameters being used to generate a corresponding group of reference gray scale voltages. The controller is configured to read one of the at least two groups of reference gray scale voltage generation parameters from the register, in response to the respective one of the different control signals received from the timing controller, so that the reference gray scale voltage generator outputs a group of reference gray scale voltages corresponding to each control signal.

In some embodiments, the processor in the timing controller is configured to output a first control signal according to a first refresh rate, the first refresh rate being a refresh rate of a first image frame to be displayed, and output a second control signal according to a second refresh rate, the second refresh rate being a refresh rate of a second image frame to be displayed. The reference gray scale voltage generator is configured to output a first group of reference gray scale voltages corresponding to the first control signal, in response to the first control signal received from the timing controller, and output a second group of reference gray scale voltages corresponding to the second control signal, in response to the second control signal received from the timing controller.

In some embodiments, the image signals of the image frames to be displayed include data signals and timing control signals, and the driving system further includes at least one source driver. The at least one source driver is connected to the reference gray scale voltage generator and the timing controller. The source driver has a plurality of output terminals, and each source driver is configured to output a plurality of gray scale voltages through the plurality of output terminals, according to the data signals from the timing controller and a group of reference gray scale voltages from the reference gray scale voltage generator.

In some embodiments, the register includes a first sub-register and a second sub-register. The first sub-register is configured to store a first group of reference gray scale voltage generation parameters that is used to generate the first group of reference gray scale voltages, and the second sub-register is configured to store a second group of reference gray scale voltage generation parameters that is used to generate the second group of reference gray scale voltages.

In yet another aspect, a display device is provided. The display device includes the driving system according to any one of the above embodiments, and a display panel.

In some embodiments, the driving system includes at least one source driver. The display panel includes a plurality of data lines, and each of at least part of the data lines is connected to an output terminal of a source driver.

In yet another aspect, a method for driving a display device is provided. The method includes: receiving image signals of image frames to be displayed; determining refresh rates of the image frames to be displayed, according to the image signals of the image frames to be displayed; and transmitting different control signals to a reference gray scale voltage generator, according to the different refresh rates of the image frames to be displayed, so that the reference gray scale voltage generator outputs a group of reference gray scale voltages corresponding to each control signal, according to a respective one of the different control signals.

In some embodiments, the reference gray scale voltage generator includes a register and a controller. Outputting, by the reference gray scale voltage generator, a group of reference gray scale voltages corresponding to each control signal, according to a respective one of the different control signals includes: reading, by the controller, one of at least two groups of reference gray scale voltage generation parameters from the register, in response to a respective one of the different control signals received from the timing controller, so that the reference gray scale voltage generator outputs a group of reference gray scale voltages corresponding to each control signal.

In some embodiments, the display device further includes at least one source driver connected to the reference gray scale voltage generator and the timing controller. Determining, by the time controller, the refresh rates of the image frames to be displayed according to the image signals of the image frames to be displayed includes: resolving the image signals of the image frames to be displayed to obtain data signals and timing control signals.

In some embodiments, the driving method further includes: outputting, by each source driver, a plurality of gray scale voltages, according to the data signals from the timing controller and a group of reference gray scale voltages from the reference gray scale voltage generator.

BRIEF DESCRIPTION OF THE DRAWINGS

In order to describe technical solutions in the present disclosure more clearly, accompanying drawings to be used in some embodiments of the present disclosure will be introduced briefly below. However, the accompanying drawings to be described below are merely accompanying drawings of some embodiments of the present disclosure, and a person of ordinary skill in the art may obtain other drawings according to these drawings. In addition, the accompanying drawings to be described below may be regarded as schematic diagrams, and are not limitations on actual sizes of products, an actual process of a method and actual timings of signals to which the embodiments of the present disclosure relate.

DETAILED DESCRIPTION

Figure 1:
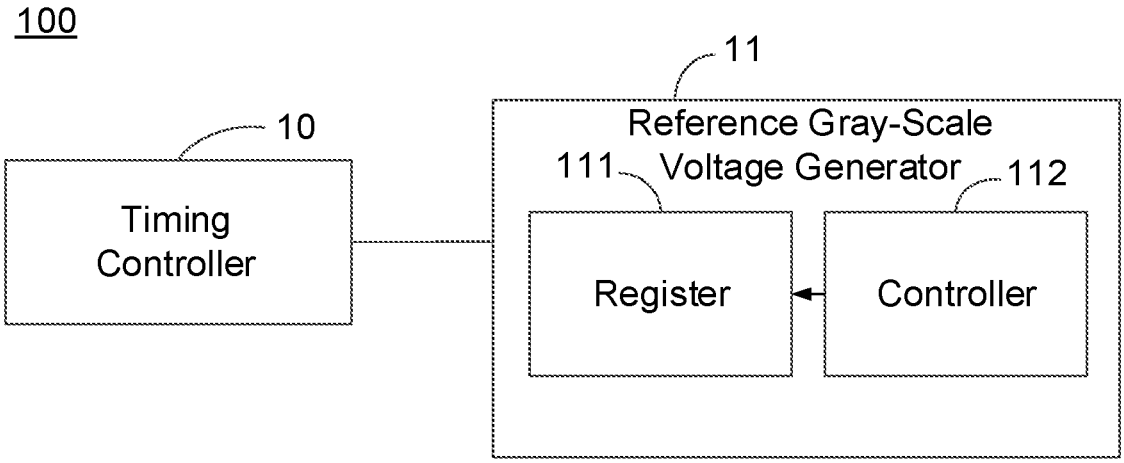
FIG. 1 is a diagram illustrating a structure of a driving system, in accordance with some embodiments of the present disclosure.

Technical solutions in some embodiments of the present disclosure will be described clearly and completely with reference to the accompanying drawings below. Obviously, the described embodiments are merely some but not all embodiments of the present disclosure. All other embodiments obtained by a person of ordinary skill in the art based on the embodiments of the present disclosure shall be included in the protection scope of the present disclosure.

Unless the context requires otherwise, throughout the description and the claims, the term "comprise" and other forms thereof such as the third-person singular form "comprises" and the present participle form "comprising" are construed as open and inclusive, i.e., "including, but not limited to." In the description, the terms such as "one embodiment", "some embodiments", "exemplary embodiments", "example", "specific example" or "some examples" are intended to indicate that specific features, structures, materials or characteristics related to the embodiment(s) or example(s) are included in at least one embodiment or example of the present disclosure. Schematic representations of the above terms do not necessarily refer to the same embodiment(s) or example(s). In addition, the specific features, structures, materials or characteristics may be included in any one or more embodiments or examples in any suitable manner.

Hereinafter, the terms "first" and "second" are used for descriptive purposes only, and are not to be construed as indicating or implying the relative importance or implicitly indicating the number of indicated technical features. Thus, features defined as "first" and "second" may explicitly or implicitly include one or more of the features. In the description of the embodiments of the present disclosure, the term "a plurality of" means two or more unless otherwise specified.

The use of the term "configured to" means an open and inclusive description which does not exclude devices that are configured to perform additional tasks or steps.

A thin film transistor-liquid crystal display (TFT-LCD) device has advantages of high resolution, high transmittance, low power consumption, wide viewing angle, high aperture ratio, low chromatic aberration, no push mura and the like.

Taking a HADS type display panel, which has two refresh rates (e.g., 60 Hz and 40 Hz) to reduce power consumption, as an example. However, there is a brightness difference between images displayed on the display panel at the two refresh rates (e.g., the brightness difference between the images displayed on the display panel at the two refresh rates of 60 Hz and 40 Hz being approximately 1.5 nit), which makes a viewer see an image flicker. A main reason for the brightness difference is as follows. Rod-like liquid crystal molecules bend in an electric field, thereby generating a flexoelectric effect, and when a refresh rate is changed, the electric field to which the liquid crystal is exposed changes, so that transmittances (T) of the liquid crystal are different at different refresh rates. As a result, a driving voltage-transmittance (V-T) curve shifts, thereby causing the luminance of the display panel to change. For example, switching between the two refresh rates of 40 Hz and 60 Hz may cause a V-T shift of less than approximately 1%. Although this value is very small, a slight luminance difference and a slight screen flicker may occur on the display panel. The higher the refresh rate, the lower an intensity of the electric field the liquid crystal is exposed to, the less the transmittance, and the less an actual luminance. Therefore, a brightness of an image displayed at the refresh rate of 40 Hz is greater than a brightness of an image displayed at the refresh rate of 60 Hz.

As shown in FIG. 1, some embodiments of the present disclosure provide a driving system 100, which includes a timing controller 21 and a reference gray scale voltage generator 11 that are connected to each other. The reference gray scale voltage generator 11 is configured to output a group of reference gray scale voltages corresponding to each control signal in response to a respective one of different control signals received from the timing controller 10, where each group of reference gray scale voltages includes a plurality of reference gray scale voltages.

For example, in response to a respective one of the different control signals, the reference gray scale voltage generator 11 reads a group of reference gray scale voltage generation parameters corresponding to each control signal, and outputs a group of reference gray scale voltages corresponding to the control signal. Each group of reference gray scale voltage generation parameters is used to generate a group of reference gray scale voltages. Herein, each group of reference gray scale voltage generation parameters may be obtained in advance and stored in the reference gray scale voltage generator 11.

The number of the reference gray scale voltages in each group of reference gray scale voltages output by the reference gray scale voltage generator 11 is not limited in the embodiments. For example, each group of reference gray scale voltages includes 14 reference gray scale voltages.

Figure 2:
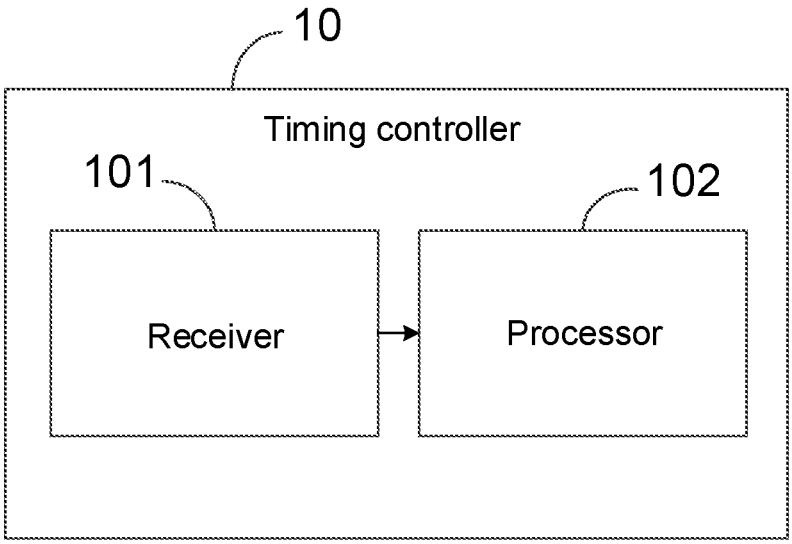
FIG. 2 is a diagram illustrating a structure of a timing controller, in accordance with some embodiments of the present disclosure.
Figure 3:
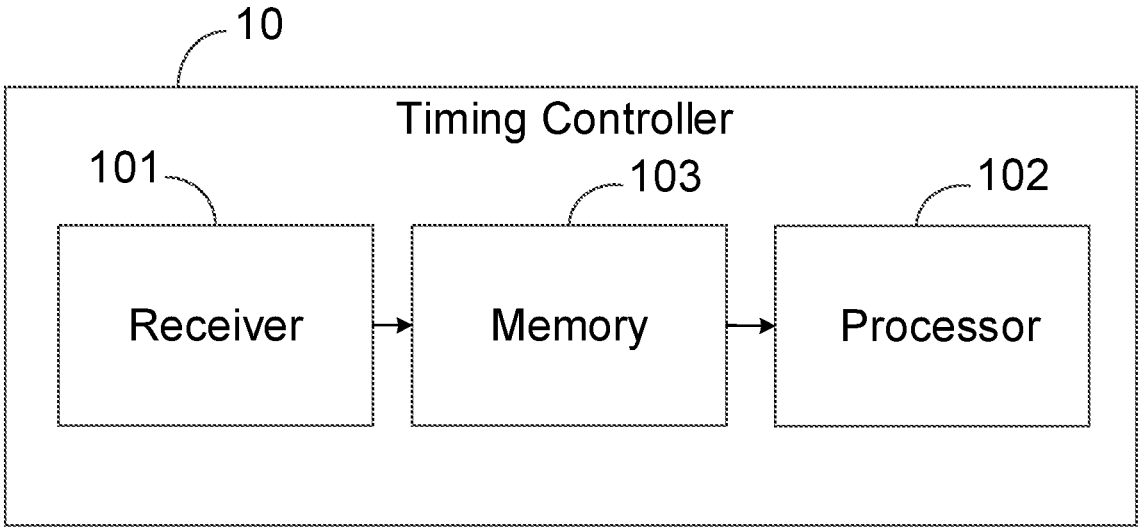
FIG. 3 is a diagram illustrating a structure of another timing controller, in accordance with some embodiments of the present disclosure.

Some embodiments of the present disclosure provide a timing controller. As shown in FIGS. 2 and 3, the timing controller 10 includes a receiver 101 and a processor 102. The receiver 101 is configured to receive image signals of image frames to be displayed. The processor 102 is configured to: determine refresh rates of the image frames to be displayed according to the image signals thereof, and output different control signals according to different refresh rates of image frames to be displayed.

It can be seen therefrom that, the timing controller 10 outputs different control signals according to different refresh rates of the image frames to be displayed; the reference gray scale voltage generator 11 outputs a group of reference gray scale voltages corresponding to each control signal in response to a respective one of the different control signals. In this way, a group of reference gray scale voltages is taken as a reference, and by reasonably setting a value of each reference gray scale voltage in each of other group(s) of reference gray scale voltages (i.e., by setting a corresponding reference gray scale voltage generation parameter), the brightness of the images on the display panel with different refresh rates may be made the same, thereby avoiding the image flicker caused by the luminance difference when there is a switch between different refresh rates.

In some embodiments, the processor 102 is configured to: resolve the image signals of the image frames to be displayed to obtain data signals and timing control signals, and determine the refresh rates of the image frames to be displayed according to the timing control signals. A data signal includes gray scale data of pixels in an image frame to be displayed. After the gray scale data are input to a source driver, the source driver transmits gray scale voltages corresponding to the gray scale data to the display panel, according to a group of reference gray scale voltages corresponding to a current refresh rate, so that the display panel displays the image frame.

In some examples, the image signals of the image frames to be displayed come from a video card. The receiver 101 is configured to: receive the image signals of the image frames to be displayed from the video card, and transmit the image signals of the image frames to be displayed to the processor 102.

In some examples, the processor 102 determines the refresh rates of the image frames to be displayed according to time lengths each between any two adjacent active levels of a respective one of the timing control signals. Herein, the active levels may be low levels or high levels.

In some examples, the processor 102 determines a refresh rate of a first image frame to be displayed as a first refresh rate according to a first time length between any two adjacent active levels of a first timing control signal, and determines a refresh rate of a second image frame to be displayed as a second refresh rate according to a second time length between any two adjacent active levels of a second timing control signal.

Figure 4:
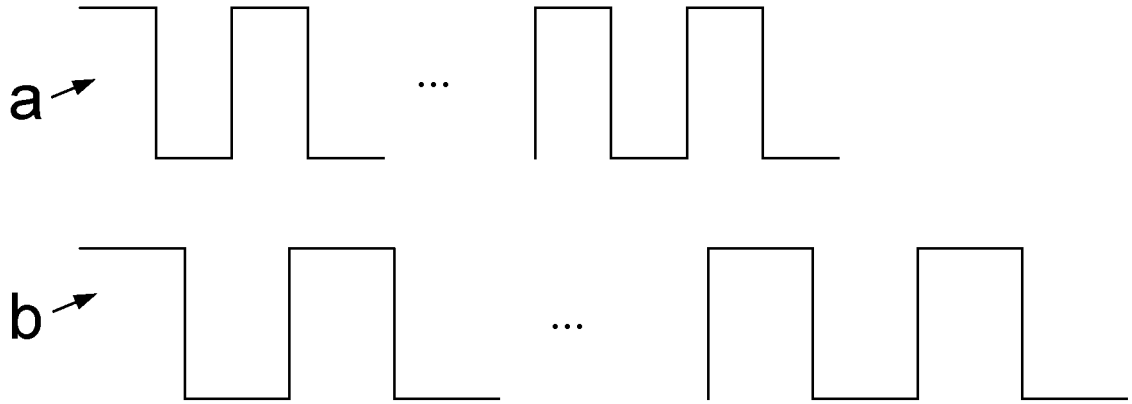
FIG. 4 is a diagram of clock signals for an image frame to be displayed at different refresh rates, in accordance with some embodiments of the present disclosure.

Exemplarily, the timing control signal is a clock signal. As shown in FIG. 4, taking an example in which the active levels of the clock signal are the high levels, and duty ratios of the high level and the low level are both 50%, in a case where a time length between any two adjacent high levels of the clock signal is t, and a time length T of high levels of the clock signal is equal to a product of n and t, with n being the number of pulses (e.g., 1080) of the clock signal for the image frame to be displayed, the refresh rate f of the image frame to be displayed is equal to ½T. For example, the time length between any two adjacent high levels of the clock signal for the first image frame to be displayed is the first time length $t_1$, which is 7.7 μs (shown as a in FIG. 4), and the refresh rate of the image frame to be displayed is the first refresh rate $f_1$, which is equal to 60 Hz. For another example, the time length between any two adjacent high levels of the clock signal for the second image frame to be displayed is the second time length $t_2$, which is 11.6 μs (shown as b in FIG. 4), and the refresh rate of the image frame to be displayed is the second refresh rate $f_2$, which is equal to 40 Hz.

In some examples, the processor outputs a first control signal according to the first refresh rate, where the first refresh rate serves as the refresh rate of the first image frame to be displayed, and outputs a second control signal according to the second refresh rate, where the second refresh rate serves as the refresh rate of the second image frame to be displayed. For example, in a case where the refresh rate of the first image frame to be displayed is 60 Hz, the processor outputs the first control signal; in a case where the refresh rate of the second image frame to be displayed is 40 Hz, the processor outputs the second control signal.

In some embodiments, as shown in FIG. 3, the timing controller 10 further includes a memory 103, which is configured to store the image signals of the image frames to be displayed.

In some examples, the receiver 101 is configured to receive the image signals of the image frames to be displayed from the video card, and transmit the image signals of the image frames to be displayed to the memory 103. The memory 103 is configured to store the image signals of the image frames to be displayed. The processor 102 is configured to: determine the refresh rates of the image frames to be displayed according to the image signals of the image frames to be displayed, and output the different control signals according to different refresh rates of the image frames to be displayed. The processor 102 determines the refresh rate of the first image frame to be displayed to be the first refresh rate (e.g., 60 Hz) according to the image signal of the first image frame to be displayed, and outputs the first control signal. For another example, the processor determines the refresh rate of the second image frame to be displayed to be the second refresh rate (e.g., 40 Hz) according to the image signal of the second image frame to be displayed, and outputs the second control signal.

In some embodiments, with continued reference to in FIG. 1, the reference gray scale voltage generator 11 includes a register 111 and a controller 112. The register 111 is configured to store at least two groups of reference gray scale voltage generation parameters. The controller 112 is configured to read one of the at least two groups of reference gray scale voltage generation parameters from the register 111, in response to a respective one of the different control signals received from the timing controller 10, so that the reference gray scale voltage generator 11 outputs a group of reference gray scale voltages corresponding to each control signal.

It will be noted that, the reference gray scale voltage generation parameters in the reference gray scale voltage generator 11 may be set by programming them, so as to obtain magnitudes of the reference gray scale voltages output by the reference gray scale voltage generator 11. Therefore, a magnitude of each reference gray scale voltage in a group of reference gray scale voltages depends on a corresponding set reference gray scale voltage generation parameter in the reference gray scale voltage generator 11.

In some examples, the processor 102 in the timing controller 10 is configured to output the first control signal according to the first refresh rate, where the first refresh rate serves as the refresh rate of the first image frame to be displayed; and output the second control signal according the second refresh rate, where the second refresh rate serves as the refresh rate of the second image frame to be displayed. The reference gray scale voltage generator 11 is configured to: output a first group of reference gray scale voltages corresponding to the first control signal, in response to the first control signal received from the timing controller 10, and output a second group of reference gray scale voltages corresponding to the second control signal, in response to the second control signal received from the timing controller 10.

For example, the first group of reference gray scale voltages and the second group of reference gray scale voltages each include 14 reference gray scale voltages. Reference gray scale voltages of the first group are $V_{gam1_1}$, $V_{gam1_2}$, $V_{gam1_3}$, $V_{gam1_4}$, $V_{gam1_5}$, $V_{gam1_6}$, $V_{gam1_7}$, $V_{gam1_8}$, $V_{gam1_9}$, $V_{gam1_10}$, $V_{gam1_11}$, $V_{gam1_12}$, $V_{gam1_13}$ and $V_{gam1_14}$, and reference gray scale voltages of the second group are $V_{gam2_1}$, $V_{gam2_2}$, $V_{gam2_3}$, $V_{gam2_4}$, $V_{gam2_5}$, $V_{gam2_6}$, $V_{gam2_7}$, $V_{gam2_8}$, $V_{gam2_9}$, $V_{gam2_10}$, $V_{gam2_11}$, $V_{gam2_12}$, $V_{gam2_13}$ and $V_{gam2_14}$. On this basis, for example, the reference gray scale voltage generator 11 includes 14 reference gray scale voltage output terminals. The 14 reference gray scale voltages in the first group are output through the 14 reference gray scale voltage output terminals, respectively. The 14 reference gray scale voltages in the second group of reference gray scale voltages are output through the 14 reference gray scale voltage output terminals.

For example, $V_{gam1_1}$, $V_{gam1_2}$, $V_{gam1_3}$, $V_{gam1_4}$, $V_{gam1_5}$, $V_{gam1_6}$ and $V_{gam1_7}$ in the first group of reference gray scale voltages, and $V_{gam2_1}$, $V_{gam2_2}$, $V_{gam2_3}$, $V_{gam2_4}$, $V_{gam2_5}$, $V_{gam2_6}$ and $V_{gam2_7}$ in the second group of reference gray scale voltages are positive. $V_{gam1_8}$, $V_{gam1_9}$, $V_{gam1_10}$, $V_{gam1_11}$, $V_{gam1_12}$, $V_{gam1_13}$ and $V_{gam1_14}$ in the first group of reference gray scale voltages, and $V_{gam2_8}$, $V_{gam2_9}$, $V_{gam2_10}$, $V_{gam2_11}$, $V_{gam2_12}$, $V_{gam2_13}$ and $V_{gm2_14}$ in the second group of reference gray scale voltages are negative. In this way, the polarity reversal of liquid crystal molecules in a liquid crystal layer may be performed as needed, which may prevent the aging of the liquid crystal molecules.

For another example, the first group of reference gray scale voltages and the second group of reference gray scale voltages each include 7 reference gray scale voltages. Reference gray scale voltages of the first group is $V_{gam1_1}$, $V_{gam1_2}$, $V_{gam1_3}$, $V_{gam1_4}$, $V_{gam1_5}$, $V_{gam1_6}$ and $V_{gam1_7}$, and reference gray scale voltages of the second group is $V_{gam2_1}$, $V_{gam2_2}$, $V_{gam2_3}$, $V_{gam2_4}$, $V_{gam2_5}$, $V_{gam2_6}$ and $V_{gam2_7}$.

Figure 5:
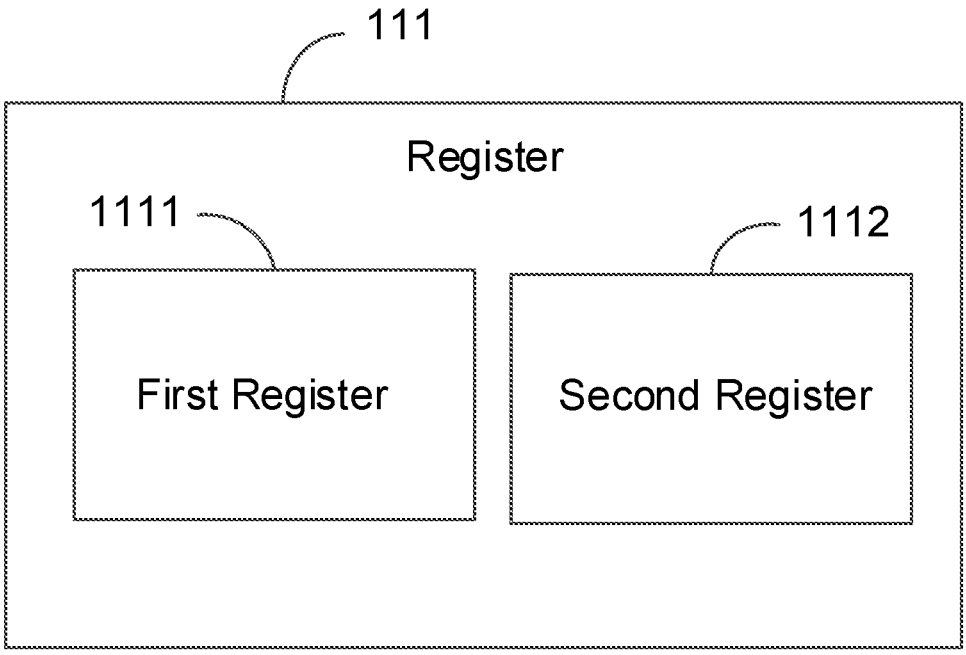
FIG. 5 is a diagram illustrating a structure of a shift register in a driving system, in accordance with some embodiments of the present disclosure.

In some examples, as shown in FIG. 5, the register 111 includes a first sub-register 1111 and a second sub-register 1112. The first sub-register 1111 is configured to store a first group of reference gray scale voltage generation parameters, which is used to generate the first group of reference gray scale voltages; the second sub-register 1112 is configured to store a second group of reference gray scale voltage generation parameters, which is used to generate the second group of reference gray scale voltages.

Figure 6A:
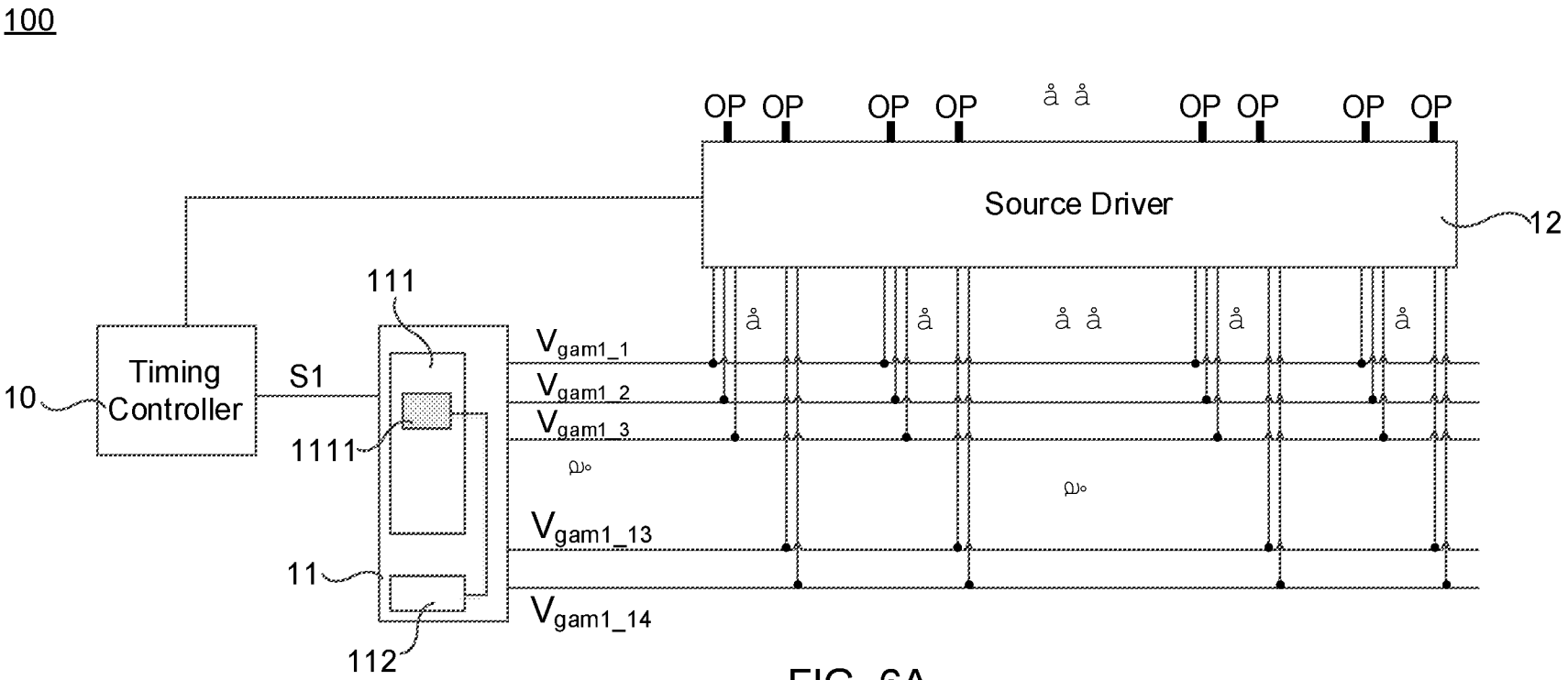
FIG. 6A is a diagram illustrating a structure of another driving system, in accordance with some embodiments of the present disclosure.

For example, as shown in FIG. 6A, the processor 101 in the timing controller 10 determines the refresh rate of the first image frame to be displayed to be the first refresh rate (e.g., 60 Hz) according to the image signal of the first image frame to be displayed, and outputs the first control signal S1. In response to the first control signal S1 received from the timing controller 10, the controller 112 in the reference gray scale voltage generator 11 reads the first group of reference gray scale voltage generation parameters from the first sub-register 1111, so that the reference gray scale voltage generator 11 outputs the first group of reference gray scale voltages corresponding to the first control signal S1, i.e., $V_{gam1_1}$, $V_{gam1_2}$, $V_{gam1_3}$, $V_{gam1_4}$, $V_{gam1_5}$, $V_{gam1_6}$, $V_{gam1_7}$, $V_{gam1_8}$, $V_{gam1_9}$, $V_{gam1_10}$, $V_{gam1_11}$, $V_{gam1_12}$, $V_{gam1_13}$ and $V_{gam1_14}$.

Figure 6B:
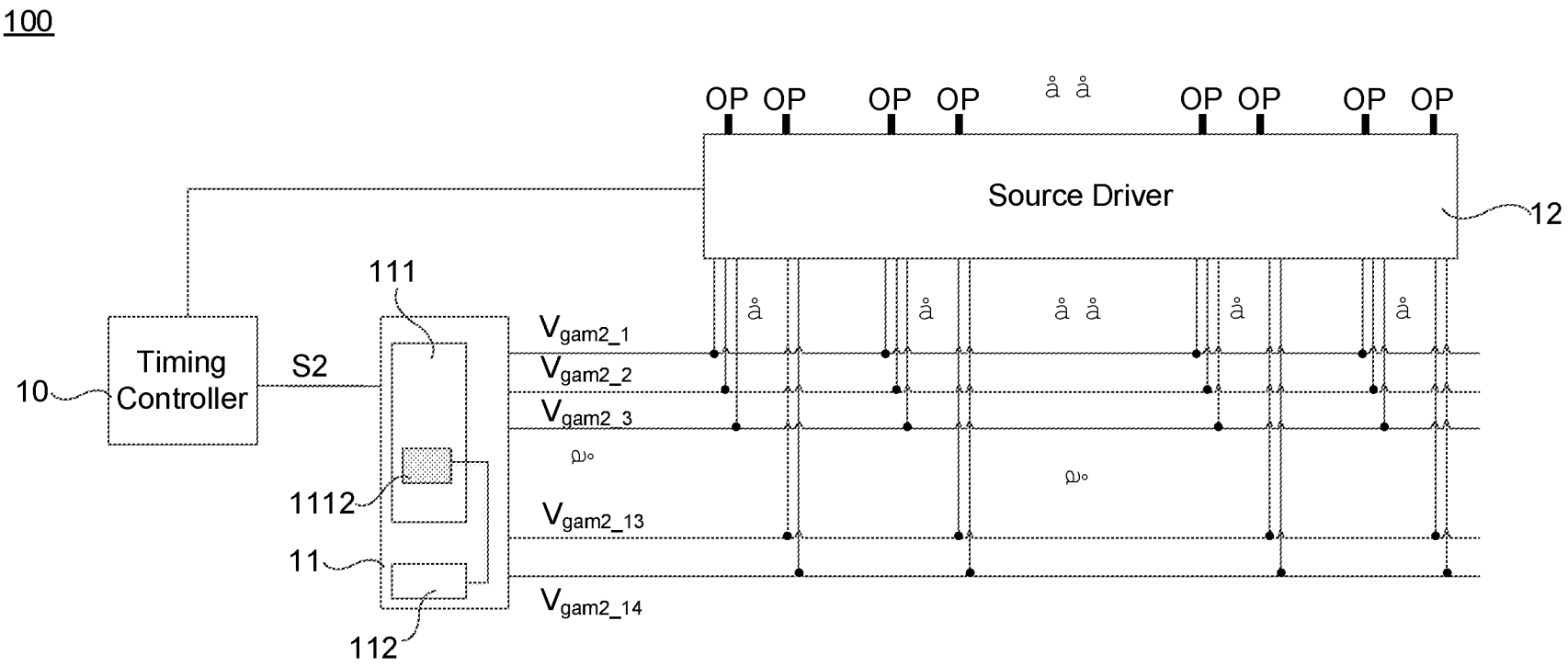
FIG. 6B is a diagram illustrating a structure of yet another driving system, in accordance with some embodiments of the present disclosure.

For another example, as shown in FIG. 6B, the processor 101 in the timing controller 10 determines the refresh rate of the second image frame to be displayed to be the second refresh rate (e.g., 40 Hz) according to the image signal of the second image frame to be displayed, and outputs the second control signal S2. In response to the second control signal S2 received from the timing controller 10, the controller 112 in the reference gray scale voltage generator 11 reads the second group of reference gray scale voltage generation parameters from the second sub-register 1112, so that the reference gray scale voltage generator 11 outputs the second group of reference gray scale voltages corresponding to the second control signal S2, i.e., $V_{gam2_1}$, $V_{gam2_2}$, $V_{gam2_3}$, $V_{gam2_4}$, $V_{gam2_5}$, $V_{gam2_6}$, $V_{gam2_7}$, $V_{gam2_8}$, $V_{gam2_9}$, $V_{gam2_10}$, $V_{gam2_11}$, $V_{gam2_12}$, $V_{gam2_13}$ and $V_{gam2_14}$.

It will be noted that, in order to clearly demonstrate the reference gray scale voltage generator 11 outputs a group of reference gray scale voltages corresponding to each control signal, according to a respective one of the different control signals, FIGS. 6A and 6B are taken as examples for illustration. However, in practice, the different control signals are each output by a same timing controller 10. Similarly, a same reference gray scale voltage generator 11 includes a plurality of sub-registers, and each sub-register stores a group of reference gray scale voltage generation parameters. The controller 112 in the reference gray scale voltage generator 11 reads a group of reference gray scale voltage generation parameters from a corresponding sub-register, in response to the different control signals, and outputs a corresponding group of reference gray scale voltages.

In some embodiments, as shown in FIGS. 6A and 6B, the driving system 100 further includes at least one source driver 12, which is connected to the reference gray scale voltage generator 11 and the timing controller 10. The source driver 12 has a plurality of output terminals OP, and each source driver 12 is configured to output a plurality of gray scale voltages through the plurality of output terminals OP, according to data signals from the timing controller 10 and a group of reference gray scale voltages from the reference gray scale voltage generator 11.

For example, the source driver 12 is a source driver integrated circuit (source IC).

In some examples, each source driver 12 is configured to output a first group of gray scale voltages through the plurality of output terminals OP, according to data signals from the timing controller 10 and the first group of reference gray scale voltages from the reference gray scale voltage generator 11.

In some other examples, each source driver 12 is configured to output a second group of gray scale voltages through the plurality of output terminals OP, according to data signals from the timing controller 10 and the second group of reference gray scale voltages from the reference gray scale voltage generator 11.

Figure 7:
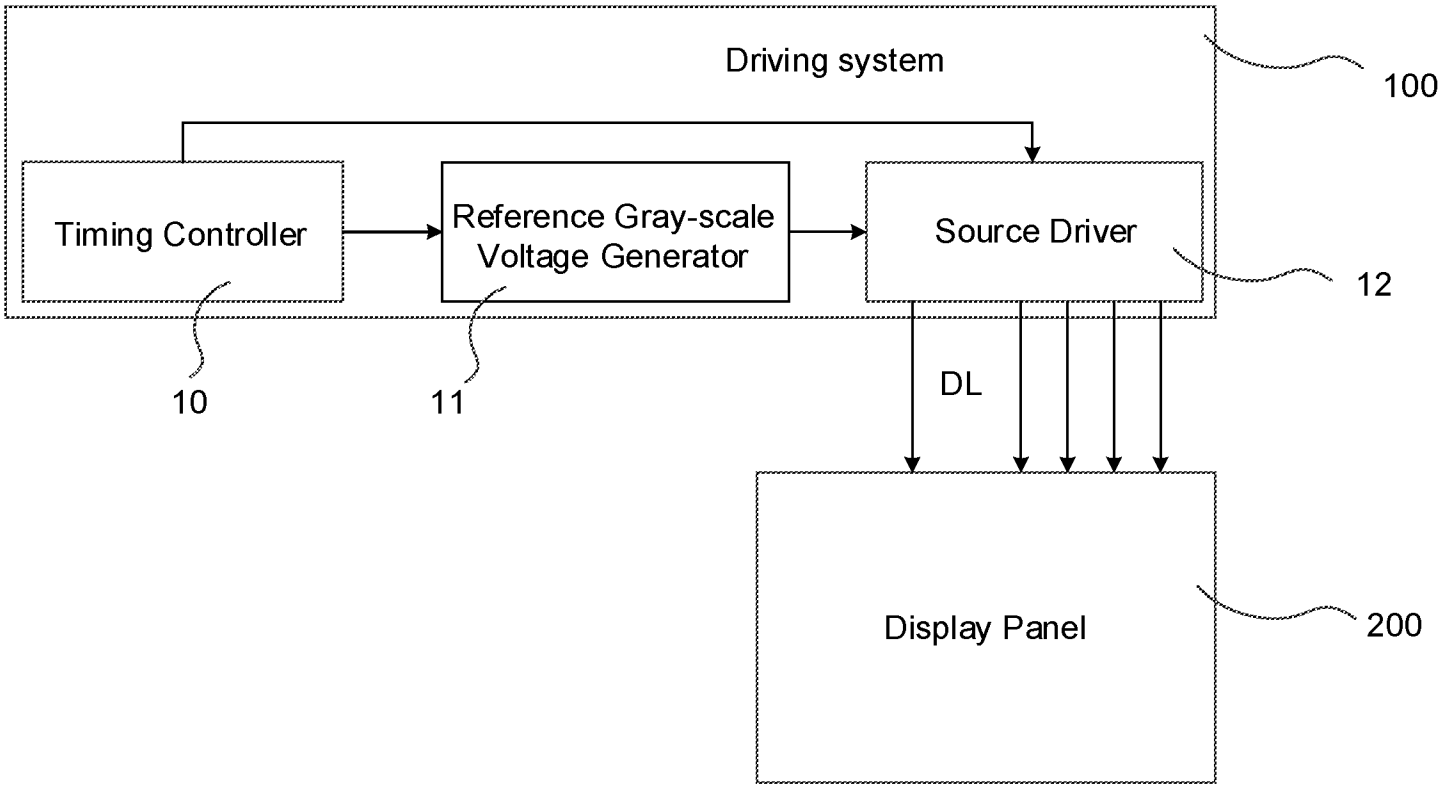
FIG. 7 is a diagram illustrating a structure of a display device, in accordance with some embodiments of the present disclosure.

As shown in FIG. 7, some embodiments of the present disclosure further provide a display device, which includes the display panel 200 and the above driving system 100. The display device may be used as a mobile phone, a tablet computer, a personal digital assistant (PDA), a vehicle-mounted computer, etc. there is no particular limit to the use of the display device in the embodiments.

Figure 8:
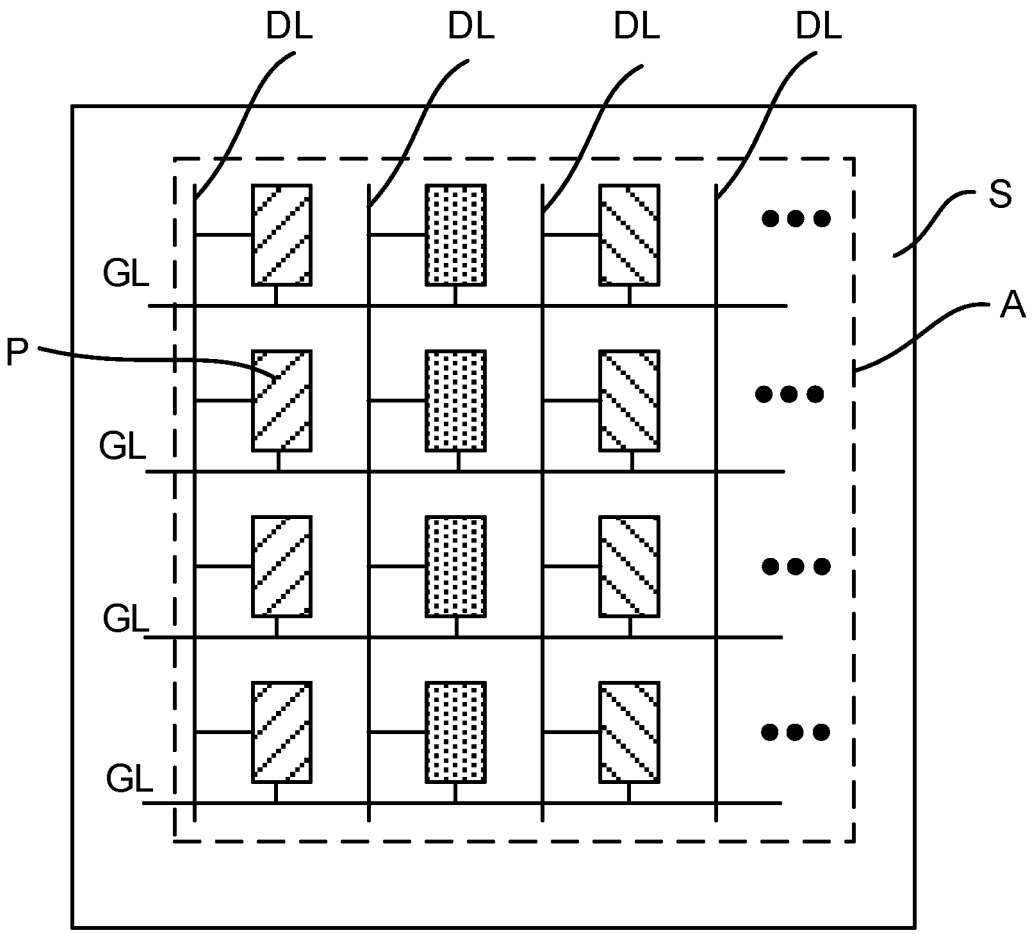
FIG. 8 is a diagram illustrating a structure of a display panel, in accordance with some embodiments of the present disclosure.

In some embodiments, as shown in FIG. 8, the display panel 200 includes a plurality of data lines DL, and each of at least part of the data lines DL is connected to an output terminal OP of a source driver 12.

In some examples, as shown in FIG. 8, the display panel 200 has an active area A and a peripheral area S. The peripheral area S, for example, is arranged around the active area A. A plurality of sub-pixels P are arranged in the active area A. The plurality of sub-pixels P include at least sub-pixels of a first color, sub-pixels of a second color and sub-pixels of a third color, where the first color, the second color and the third color are three primary colors (e.g., red, green and blue).

The source driver 12 outputs a plurality of gray scale voltages according to the data signals from the timing controller 10 and a group of reference gray scale voltages from the reference gray scale voltage generator 11, and transmits the plurality of gray scale voltages to the plurality of data lines DL. Herein, each gray scale voltage is transmitted to one sub-pixel of the display panel 200.

For example, as shown in FIG. 8, the plurality of data lines DL are connected to a plurality of columns of sub-pixels, and a plurality of gate lines GL are connected to a plurality of rows of sub-pixels. After a scanning signal is transmitted to a first row gate line GL, the at least one source driver 12 transmits a plurality of gray scale voltages to the plurality of data lines DL, through which the plurality of gray scale voltages are transmitted to a first row of sub-pixels; after a scanning signal is transmitted to a second row gate lines GL, the at least one source driver 12 transmits a plurality of gray scale voltages to the plurality of data lines DL, through which the plurality of gray scale voltages are transmitted to a second row of sub-pixels; after a scanning signal is transmitted to a third row gate lines GL, the at least one source driver 12 transmits a plurality of gray scale voltages to the plurality of data lines DL, through which the plurality of gray scale voltages are transmitted to a third row of sub-pixels; and so on, until after a scanning signal is input to a last row gate lines GL, the at least one source driver 12 transmits a plurality of gray scale voltages to the plurality of data lines DL, through which the plurality of gray scale voltages are transmitted to a last row of sub-pixels.

It can be seen therefrom that, when the display panel displays images, within time of a frame image, the at least one source driver outputs a plurality of gray scale voltages according to a data signal from the timing controller 10 and a group of reference gray scale voltages from the reference gray scale voltage generator 11 within a scanning time of each row of sub-pixels.

In some examples of the present disclosure, the processor 101 in the timing controller 10 determines the refresh rate of the first image frame to be displayed to be the first refresh rate (e.g., 60 Hz) according to the image signal of the first image frame to be displayed, and outputs the first control signal S1. As shown in FIG. 6A, in response to the first control signal S1 received from the timing controller 10, the controller 112 in the reference gray scale voltage generator 11 reads the first group of reference gray scale voltage generation parameters from the first sub-register 1111, so that the reference gray scale voltage generator 11 outputs the first group of reference gray scale voltages corresponding to the first control signal S1, e.g., $V_{gam1_1}$, $V_{gam1_2}$, $V_{gam1_3}$, $V_{gam1_4}$, $V_{gam1_5}$, $V_{gam1_6}$, $V_{gam1_7}$, $V_{gam1_8}$, $V_{gam1_9}$, $V_{gam1_10}$, $V_{gam1_11}$, $V_{gam1_12}$, $V_{gam1_13}$ and $V_{gam1_14}$. The source driver outputs the first group of gray scale voltages according to the data signal from the timing controller 10 and the first group of reference gray scale voltages from the reference gray scale voltage generator 11, and transmits the first group of gray scale voltages to a plurality of sub-pixels in a row of sub-pixels connected to the plurality of data lines DL. In this case, the luminance of the display panel 200 is L1.

In some other examples, the processor 101 in the timing controller 10 determines the refresh rate of the second image frame to be displayed to be the second refresh rate (e.g., 40 Hz) according to the image signal of the second image frame to be displayed, and outputs the second control signal S2. As shown in FIG. 6B, in response to the second control signal S2 received from the timing controller 10, the controller 112 in the reference gray scale voltage generator 11 reads the second group of reference gray scale voltage generation parameters from the second sub-register 1112, so that the reference gray scale voltage generator 11 outputs the second group of reference gray scale voltages corresponding to the second control signal S2, e.g., $V_{gam2_1}$, $V_{gam2_2}$, $V_{gam2_3}$, $V_{gam2_4}$, $V_{gam2_5}$, $V_{gam2_6}$, $V_{gam2_7}$, $V_{gam2_8}$, $V_{gam2_9}$, $V_{gam2_10}$, $V_{gam2_11}$, $V_{gam2_12}$, $V_{gam2_13}$ and $V_{gam2_14}$. The source driver outputs the second group of gray scale voltages according to the data signal from the timing controller 10 and the second group of reference gray scale voltages from the reference gray scale voltage generator 11, and transmits the second group of gray scale voltages to the plurality of sub-pixels in the row of sub-pixels connected to the plurality of data lines DL. In this case, the luminance of the display panel 200 is L2.

On this basis, for example, the second group of reference gray scale voltage generation parameters is set as follows. The display luminance L1 of the display panel at the first refresh rate (e.g., 60 Hz) is taken as a baseline; the first group of reference gray scale voltage generation parameters are adjusted, and the luminance of the display panel at the second refresh rate (e.g., 40 Hz) is measured, until the display luminance L2 of the display panel at the second refresh rate (e.g., 40 Hz) is equal to L1. At this time, the adjusted first group of reference gray scale voltage generation parameters is set as the second group of reference gray scale voltage generation parameters. Herein, the luminance may be measured with a luminance meter.

Figure 9:
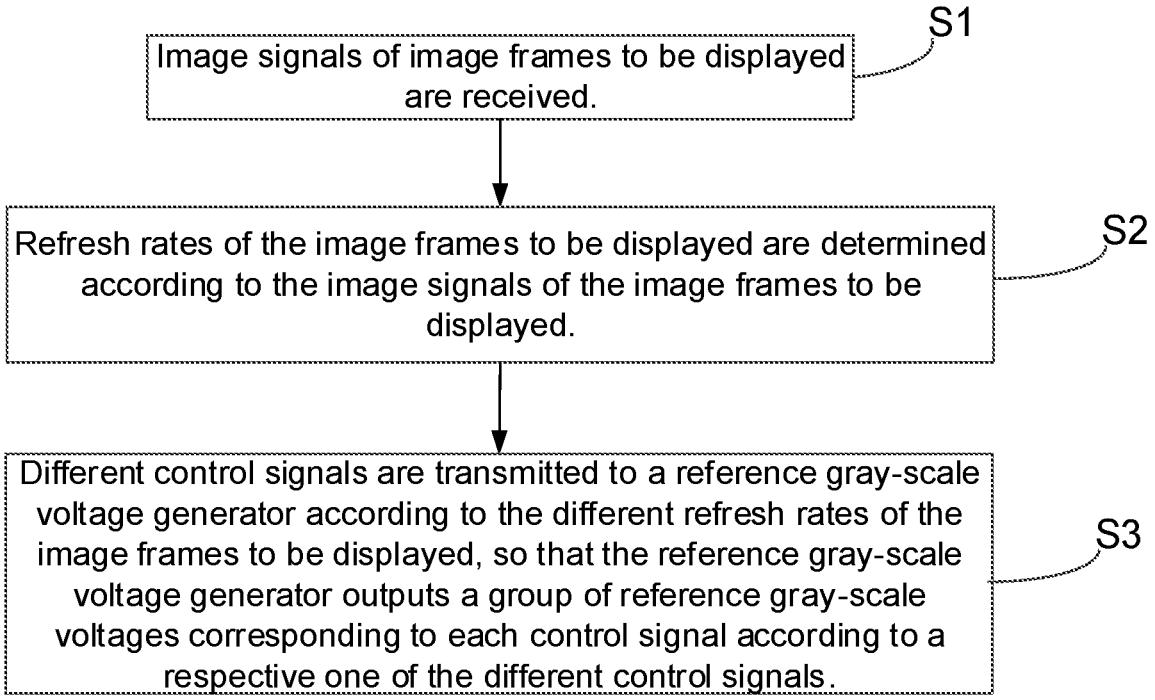
FIG. 9 is a flow diagram of a method for driving a display device, in accordance with some embodiments of the present disclosure.

Some embodiments of the present disclosure further provide a method for driving a display device, as shown in FIG. 9, the method includes S1 to S3.

In S1, image signals of image frames to be displayed are received.

In S2, refresh rates of the image frames to be displayed are determined according to the image signals of the image frames to be displayed.

In S3, different control signals are transmitted to the reference gray scale voltage generator, according to different refresh rates of the image frames to be displayed, so that the reference gray scale voltage generator outputs a group of reference gray scale voltages corresponding to each control signal, according to a respective one of the different control signals.

In some examples, the timing controller 10 receives the image signal of the image frame to be displayed, and resolves the image signal of the image frame to be displayed to obtain a data signal and a timing control signal. The timing controller 10 determines a refresh rate of a first image frame to be displayed as a first refresh rate (e.g., 60 Hz) according to a first timing control signal (e.g., a clock signal). The timing controller 10 transmits a first control signal S1 to the reference gray scale voltage generator 11 according to the first refresh rate, where the first refresh rate serves as the refresh rate of the first image frame to be displayed, so that the reference gray scale voltage generator 11 reads a first group of reference gray scale voltage generation parameters stored in the reference gray scale voltage generator 11 according to the first control signal S1, and outputs a first group of reference gray scale voltages corresponding to the first control signal S1, e.g., $V_{gam1_1}$, $V_{gam1_2}$, $V_{gam1_3}$, $V_{gam1_4}$, $V_{gam1_5}$, $V_{gam1_6}$, $V_{gam1_7}$, $V_{gam1_8}$, $V_{gam1_9}$, $V_{gam1_10}$, $V_{gam1_11}$, $V_{gam1_12}$, $V_{gam1_13}$ and $V_{gam1_14}$. Accordingly, the source driver 12 outputs a first group of gray scale voltages according to the data signal from the timing controller 10 and the first group of reference gray scale voltages from the reference gray scale voltage generator 11, and transmits the first group of gray scale voltages to the plurality of sub-pixels in the row of sub-pixels connected to the plurality of data lines DL. In this case, the luminance of the display panel 200 is L1.

In a case where there is a refresh rate switch of the display panel, the timing controller 10 resolves an image signal of a second image frame to be displayed to obtain a data signal and a second timing control signal, according to the image signal of the second image frame to be displayed; and determines the second image frame to be displayed switches to the second refresh rate (e.g., 40 Hz), according to the second timing control signal. The timing controller 10 transmits a second control signal S2 to the reference gray scale voltage generator 11, so that the reference gray scale voltage generator 11 reads a second group of reference gray scale voltage generation parameters stored in the reference gray scale voltage generator 11 according to the second control signal S2, and outputs a second group of reference gray scale voltages corresponding to the second control signal S2, e.g., $V_{gam2_1}$, $V_{gam2_2}$, $V_{gam2_3}$, $V_{gam2_4}$, $V_{gam2_5}$, $V_{gam2_6}$, $V_{gam2_7}$, $V_{gam2_8}$, $V_{gam2_9}$, $V_{gam2_10}$, $V_{gam2_11}$, $V_{gam2_12}$, $V_{gam2_13}$ and $V_{gam2_14}$. Accordingly, the source driver outputs a second group of gray scale voltages according to the data signal from the timing controller 10 and the second group of reference gray scale voltages from the reference gray scale voltage generator 11, and transmits the second group of gray scale voltages to the plurality of sub-pixels in the row of sub-pixels connected to the plurality of data lines DL. In this case, the luminance of the display panel 200 is L2.

On this basis, for example, the second group of reference gray scale voltage generation parameters is set as follows. The display luminance L1 of the display panel at the first refresh rate (e.g., 60 Hz) is taken as a baseline; the first group of reference gray scale voltage generation parameters are adjusted, and the luminance of the display panel at the second refresh rate (e.g., 40 Hz) is measured, until the luminance L2 of the display panel at the second refresh rate (e.g., 40 Hz) is equal to L1. At this time, the adjusted first group of reference gray scale voltage generation parameters is set as the second group of reference gray scale voltage generation parameters.

It will be noted that, the first group of reference gray scale voltage generation parameters and the second group of reference gray scale voltage generation parameters are both obtained in advance and stored in the reference gray scale voltage generator 11.

The foregoing descriptions are merely specific implementations of the present disclosure, but the protection scope of the present disclosure is not limited thereto. Any changes or replacements that a person skilled in the art could conceive of within the technical scope of the present disclosure shall be included in the protection scope of the present disclosure. Therefore, the protection scope of the present disclosure shall be subject to the protection scope of the claims.

What is claimed is:

1. A timing controller, comprising:

a receiver configured to receive image signals of image frames to be displayed; and a processor configured to determine refresh rates of the image frames to be displayed according to the image signals of the image frames to be displayed, and output different control signals according to different refresh rates of the image frames to be displayed, wherein in a process of determining the refresh rates of the image frames to be displayed according to the image signals of the image frames to be displayed, the processor is configured to:

resolve the image signals of the image frames to be displayed to obtain data signals and timing control signals; and determine the refresh rates of the image frames to be displayed according to the timing control signals, wherein in a process of determining the refresh rates of the image frames to be displayed according to the timing control signals, the processor is configured to:

determine the refresh rates of the image frames to be displayed according to time lengths each between any two adjacent active levels in a respective one of the timing control signals.

2. The timing controller according to claim 1, wherein in a process of determining the refresh rates of the image frames to be displayed according to the time lengths each between any two adjacent active levels in the respective one of the timing control signals, the processor is configured to:

determine a refresh rate of a first image frame to be displayed to be a first refresh rate, according to a first time length between any two adjacent active levels in a first timing control signal; and determine a refresh rate of a second image frame to be displayed to be a second refresh rate, according to a second time length between any two adjacent active levels in a second timing control signal.

3. The timing controller according to claim 2, wherein in a process of outputting the different control signals according to the different refresh rates of the image frame to be displayed, the processor is configured to:

output a first control signal according to the first refresh rate, the first refresh rate being the refresh rate of the first image frame to be displayed; and output a second control signal according to the second refresh rate, the second refresh rate being the refresh rate of the second image frame to be displayed.

4. The timing controller according to claim 1, further comprising:

a memory configured to store the image signals of the image frames to be displayed.

5. A driving system, comprising:

the timing controller according to claim 1; and a reference gray scale voltage generator connected to the timing controller, wherein the reference gray scale voltage generator is configured to output a group of reference gray scale voltages corresponding to each control signal, in response to a respective one of the different control signals received from the timing controller, each group of reference gray scale voltages including a plurality of reference gray scale voltages.

6. The driving system according to claim 5, wherein the reference gray scale voltage generator includes:

a register, configured to store at least two groups of reference gray scale voltage generation parameters, each group of reference gray scale voltage generation parameters being used to generate a corresponding group of reference gray scale voltages; and a controller, configured to read one of the at least two groups of reference gray scale voltage generation parameters from the register, in response to the respective one of the different control signals received from the timing controller, so that the reference gray scale voltage generator outputs a group of reference gray scale voltages corresponding to each control signal.

7. The driving system according to claim 6, wherein the processor in the timing controller is configured to output a first control signal according to a first refresh rate, the first refresh rate being a refresh rate of a first image frame to be displayed, and output a second control signal according to a second refresh rate, the second refresh rate being a refresh rate of a second image frame to be displayed; and the reference gray scale voltage generator is configured to output a first group of reference gray scale voltages corresponding to the first control signal, in response to the first control signal received from the timing controller, and output a second group of reference gray scale voltages corresponding to the second control signal, in response to the second control signal received from the timing controller.

8. The driving system according to claim 7, wherein the register includes:

a first sub-register, configured to store a first group of reference gray scale voltage generation parameters that is used to generate the first group of reference gray scale voltages; and a second sub-register, configured to store a second group of reference gray scale voltage generation parameters that is used to generate the second group of reference gray scale voltages.

9. The driving system according to claim 5, wherein the image signals of the image frames to be displayed include data signals and timing control signals; the driving system further comprises:

at least one source driver connected to the reference gray scale voltage generator and the timing controller, wherein the source driver has a plurality of output terminals, and each source driver is configured to output a plurality of gray scale voltages through the plurality of output terminals, according to the data signals from the timing controller and a group of reference gray scale voltages from the reference gray scale voltage generator.

10. A display device, comprising:

the driving system according to claim 5; and a display panel.

11. The display device according to claim 10, wherein the driving system includes at least one source driver; and the display panel includes a plurality of data lines, and each of at least part of the data lines is connected to an output terminal of a source driver.

12. A method for driving a display device, wherein the display device includes a time controller, a reference gray scale voltage generator; the driving method comprises:

receiving, by a time controller, image signals of image frames to be displayed;

determining, by the time controller, refresh rates of the image frames to be displayed, according to the image signals of the image frames to be displayed;

transmitting, by the time controller, different control signals to a reference gray scale voltage generator, according to the different refresh rates of the image frames to be displayed; and outputting, by the reference gray scale voltage generator, a group of reference gray scale voltages corresponding to each control signal, according to a respective one of the different control signals, wherein the determining the refresh rates of the image frames to be displayed according to the image signals of the image frames to be displayed includes:

resolving the image signals of the image frames to be displayed to obtain data signals and timing control signals; and determining the refresh rates of the image frames to be displayed according to the timing control signals;

wherein the determining the refresh rates of the image frames to be displayed according to the timing control signals includes:

determining the refresh rates of the image frames to be displayed according to time lengths each between any two adjacent active levels in a respective one of the timing control signals.

13. The method for driving the display device according to claim 12, wherein the reference gray scale voltage generator includes a register and a controller;

outputting, by the reference gray scale voltage generator, a group of reference gray scale voltages corresponding to each control signal, according to a respective one of the different control signals includes:

reading, by the controller, one of at least two groups of reference gray scale voltage generation parameters from the register, in response to a respective one of the different control signals received from the timing controller, so that the reference gray scale voltage generator outputs a group of reference gray scale voltages corresponding to each control signal.

14. The method for driving the display device according to claim 12, wherein the display device further includes at least one source driver connected to the reference gray scale voltage generator and the timing controller; and wherein determining, by the time controller, the refresh rates of the image frames to be displayed according to the image signals of the image frames to be displayed includes:

resolving the image signals of the image frames to be displayed to obtain data signals and timing control signals.

15. The method for driving the display device according to claim 14, further comprises:

outputting, by each source driver, a plurality of gray scale voltages, according to the data signals from the timing controller and a group of reference gray scale voltages from the reference gray scale voltage generator.

* * * * *